US007250958B2

(12) United States Patent
Kim et al.

(10) Patent No.: US 7,250,958 B2
(45) Date of Patent: Jul. 31, 2007

(54) METHOD OF PRINTING THERMAL MEDIA BY ALIGNING IMAGE

(75) Inventors: Hyoung-il Kim, Suwon-si (KR); Kyung-pyo Kang, Suwon-si (KR)

(73) Assignee: Samsung Electronics Co., Ltd, Suwon-Si (KR)

( * ) Notice: Subject to any disclaimer, the term of this patent is extended or adjusted under 35 U.S.C. 154(b) by 154 days.

(21) Appl. No.: 11/154,526

(22) Filed: Jun. 17, 2005

(65) Prior Publication Data

US 2006/0012666 A1 Jan. 19, 2006

(30) Foreign Application Priority Data

Jul. 14, 2004 (KR) ..... 10-2004-0054701

(51) Int. Cl.
*B41J 2/315* (2006.01)

(52) U.S. Cl. ..... 347/177

(58) Field of Classification Search ..... 347/171, 347/172, 174–177
See application file for complete search history.

(56) References Cited

U.S. PATENT DOCUMENTS

| | | | | |
|---|---|---|---|---|
| 5,101,222 | A | 3/1992 | Kunio | |
| 5,488,458 | A | 1/1996 | Benedict et al. | |
| 6,201,255 | B1 | 3/2001 | Torchalski et al. | |
| 6,601,952 | B2 * | 8/2003 | Sugioka et al. | 347/104 |
| 6,705,786 | B2 * | 3/2004 | Trovinger | 400/645.3 |
| 2001/0022609 | A1 | 9/2001 | Etsuro | |
| 2002/0001027 | A1 | 1/2002 | Hideyuki | |
| 2003/0125206 | A1 | 7/2003 | Bhatt et al. | |
| 2005/0140770 | A1 * | 6/2005 | Kang et al. | 347/198 |
| 2005/0140771 | A1 * | 6/2005 | Lee et al. | 347/215 |
| 2005/0254191 | A1 * | 11/2005 | Bashaw et al. | 361/62 |

FOREIGN PATENT DOCUMENTS

| | | |
|---|---|---|
| JP | 01-242273 | 9/1989 |
| JP | 02-219661 | 9/1990 |
| JP | 09-278232 | 10/1997 |
| JP | 10-138544 | 5/1998 |

* cited by examiner

*Primary Examiner*—Huan Tran
(74) *Attorney, Agent, or Firm*—Roylance, Abrams, Berdo & Goodman, L.L.P.

(57) ABSTRACT

A method for printing on a thermal medium by aligning test patterns comprises the steps of feeding a thermal medium to a print starting position of the medium beyond a predetermined distance from a heating elements of a thermal printhead; printing a first test pattern when a front edge of the medium is detected by an edge detection sensor; measuring a first distance between the front edge and the first test pattern by detecting the first test pattern using the edge detection sensor; rotating the thermal printhead to face the second surface; feeding the thermal medium to the print starting position of the medium is beyond predetermined distance the thermal printhead; printing a predetermined second test pattern when the front edge of the medium is detected by the edge detection sensor while feeding the medium; and measuring a second distance between the front edge and the second test pattern.

13 Claims, 7 Drawing Sheets

METHOD OF PRINTING THERMAL MEDIA BY ALIGNING IMAGE

CROSS-REFERENCE TO RELATED APPLICATION

This application claims the benefit under 35 U.S.C. §119 (a) of Korean Patent Application No. 10-2004-0054701, filed on Jul. 14, 2004, in the Korean Intellectual Property Office, the entire disclosure of which is hereby incorporated by reference.

BACKGROUND OF THE INVENTION

1. Field of the Invention

The present invention relates to a method of printing on a thermal medium by aligning a test pattern. More particularly, the present invention relates to a method of printing on a thermal medium by aligning print starting positions at a first surface and a second surface of the medium, which is used in a thermal printer.

2. Description of the Related Art

A thermal printer can be divided into a type of printer that uses a medium that represents a predetermined color by responding to heat (hereinafter, referred to as thermal medium), and a type of printer that uses an ink ribbon that transfers a predetermined color onto a general medium responding to the heat in order to print images on the general medium. The ink ribbon type of printer uses a driving device for operating the ink ribbon, thus it has a more complex structure and a correspondingly higher price. Also, the ink ribbon needs periodic replacement, which increases the per page printing price.

Referring to FIG. 1, a thermal medium 10 includes a base sheet 11 having two surfaces, that is, a first surface 10*a* and a second surface 10*b*, on which ink layers of predetermined colors are respectively formed. The ink layers are formed to have different colors from each other. For example, a yellow (Y) layer and a magenta (M) layer are sequentially stacked on the first surface 10*a*, and a cyan (C) layer is formed on the second surface 10*b*. It is desirable that the base sheet 11 is formed of a transparent material. Reference numeral 13 is a reflective layer that reflects light so that a color image can be seen on the first surface 10*a*. An example of the thermal medium 10 is disclosed in U.S. Pat. No. 6,801,233, which is assigned to the Polaroid Corporation, the entire contents of which are incorporated herein by reference.

The thermal printer using the thermal medium 10 uses a thermal printhead (TPH), in which heating elements are disposed perpendicular to the direction in which the printing sheet is fed. To perform dual-surface printing using one TPH, the printing process for the first surface 10*a* of the medium 10 is performed, and then, the printing process for the second surface 10*b* of the medium 10 is performed again using the same TPH. When the two surfaces are printed, a color image can be seen on the first surface 10*a*.

FIG. 2 is a view illustrating a structure of a conventional thermal printer. Referring to FIG. 2, the thermal printer includes a feeding roller 2 that conveys the thermal medium 10, a platen 3 supporting a surface of the medium 10, and a TPH 4 forming an image on the medium 10 that is disposed on the platen 3. A printer having one TPH 4 typically prints on both surfaces of the medium 10 in sequential order by rotating the medium 10 or the TPH 4. Reference numeral 5 is an idle roller that pushes the medium 10 that passes between the idle roller 5 and the feeding roller 2 toward the feeding roller 2.

In the case where the TPH is not aligned with the medium when the TPH is rotated for printing images on the second surface after printing images on the first surface, the color printing operation can produce misaligned printed images on the second surface.

Therefore, a method of aligning a print starting position of the medium is required when the first and second surfaces of the medium are printed.

SUMMARY OF THE INVENTION

The present invention provides a method for printing a thermal medium that is used in a thermal printer by aligning the print starting position.

According to an aspect of the present invention, there is provided a method for printing a thermal medium by aligning image, the method comprising the steps of (a) feeding a thermal medium having a first surface and a second surface so that a print starting position of the medium is past a predetermined distance from a heating elements of a thermal printhead; (b) printing a first test pattern on the first surface when a front edge of the medium is detected by an edge detection sensor; (c) measuring a first distance between the front edge and the first test pattern by detecting the first test pattern using the edge detection sensor; (d) rotating the thermal printhead to face the second surface; (e) feeding the thermal medium so that the print starting position of the medium is past a predetermined distance from the heating elements of the thermal printhead, (f) printing a predetermined second test pattern on the second surface when the front edge of the medium is detected by the edge detection sensor; and (g) measuring a second distance between the front edge and the second test pattern by detecting the second test pattern.

Step (b) may further comprise the step of measuring a third distance by subtracting the first distance from a distance between the front edge and the print starting position, wherein a position where the medium is fed the third distance from a point when the front edge is detected is defined as the print starting position of the first surface.

Step (g) may further comprise the step of calculating a fourth distance by subtracting the second distance from the distance between the front edge and the print starting position, wherein a position where the medium is fed the fourth distance from a point when the front edge is detected is defined as the print starting position of the second surface.

The thermal printhead, a feeding roller, and the edge detection sensor may be sequentially disposed in a printing direction, and steps (a) and (e) may be locating the front edge between the feeding roller and the edge detection sensor.

The method may further comprise the steps of (h) feeding the thermal medium so that the print starting position of the medium is past a predetermined distance from the heating elements of the thermal printhead; (i) feeding the medium and starting a printing operation of the first surface at the position where the medium is fed the third distance from the point when the front edge is detected by the edge detection sensor; (j) rotating the thermal printhead to face the second surface; (k) feeding the medium so that the print starting position is past a predetermined distance from the heating elements of the thermal printhead; and (l) feeding the medium and starting a printing operation of the second surface at the position where the medium is fed the fourth distance from when the front edge is detected by the edge detection sensor.

Steps (i) and (l) may comprise detecting the front edge of the medium by the edge detection sensor; and controlling a rotation of the feeding roller so that the front edge can be separated at the third distance or the fourth distance from the sensor.

The thermal medium may include a print region and a tear-off region including the front edge, and the print starting position may be formed at the tear-off region.

The edge detection sensor may be an optical sensor or other suitable sensing means.

According to another aspect of the present invention, there is provided a method of printing a thermal medium by aligning image comprising the steps of (a) moving a thermal medium having a first surface and a second surface so that a print starting position of the medium is past a predetermined distance from heating elements of a thermal printhead; (b) moving the medium, determining a position where the medium is fed a first distance from a point when a front edge is detected as the print starting position, performing a printing process of the first surface; (c) rotating the thermal printhead to face the second surface; (d) moving the medium so that the print starting position is past a predetermined distance from the heating elements of the thermal printhead; and (e) moving the medium, determining a position where the medium is fed a second distance from a point when a front edge is detected as the print starting position, and performing a printing process of the second surface.

Steps (b) and (e) may comprise detecting the front edge of the medium using the edge detection sensor; and controlling the rotation of the feeding roller so that the front edge can be separated the first distance or the second distance from the sensor.

BRIEF DESCRIPTION OF THE DRAWINGS

The above and other features and advantages of the present invention will become more apparent by describing in detail exemplary embodiments thereof with reference to the attached drawings in which.

Throughout the drawings, it should be understood that like reference numbers refer to like features, structures and elements.

DETAILED DESCRIPTION OF EXEMPLARY EMBODIMENTS

Hereinafter, a method for printing on a thermal medium by aligning an image according to embodiments of the present invention will be described with reference to the accompanying drawings.

Figure 1:
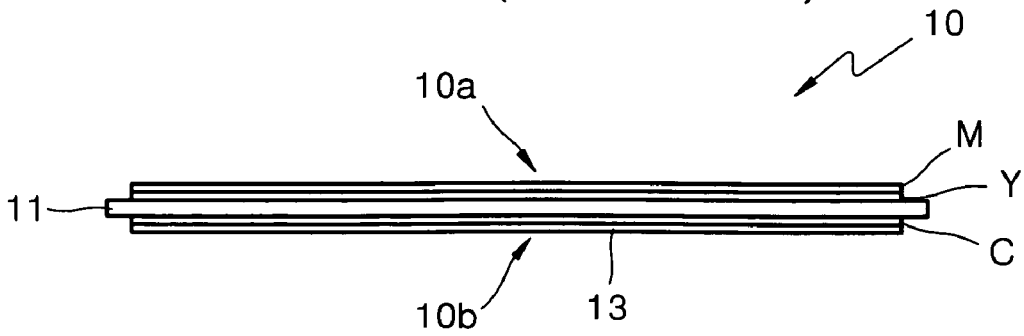
FIG. 1 (PRIOR ART)
FIG. 1 is a cross-sectional view showing a conventional thermal medium.
Figure 2:
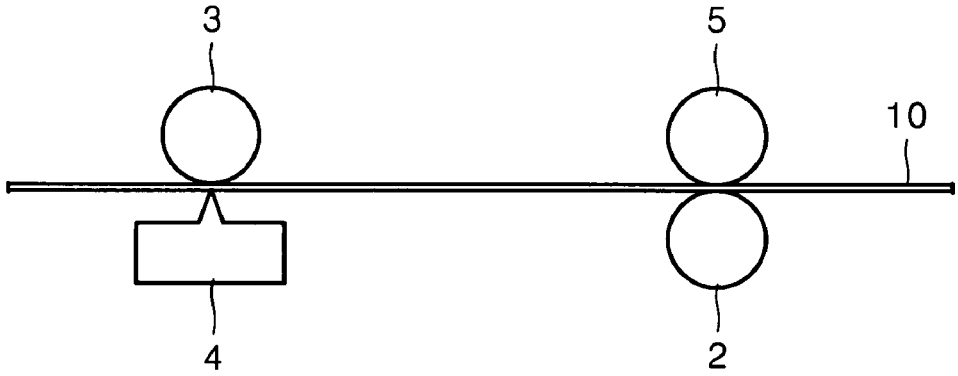
FIG. 2 (PRIOR ART)
FIG. 2 is a view showing a structure of a conventional thermal printer.
Figure 3:
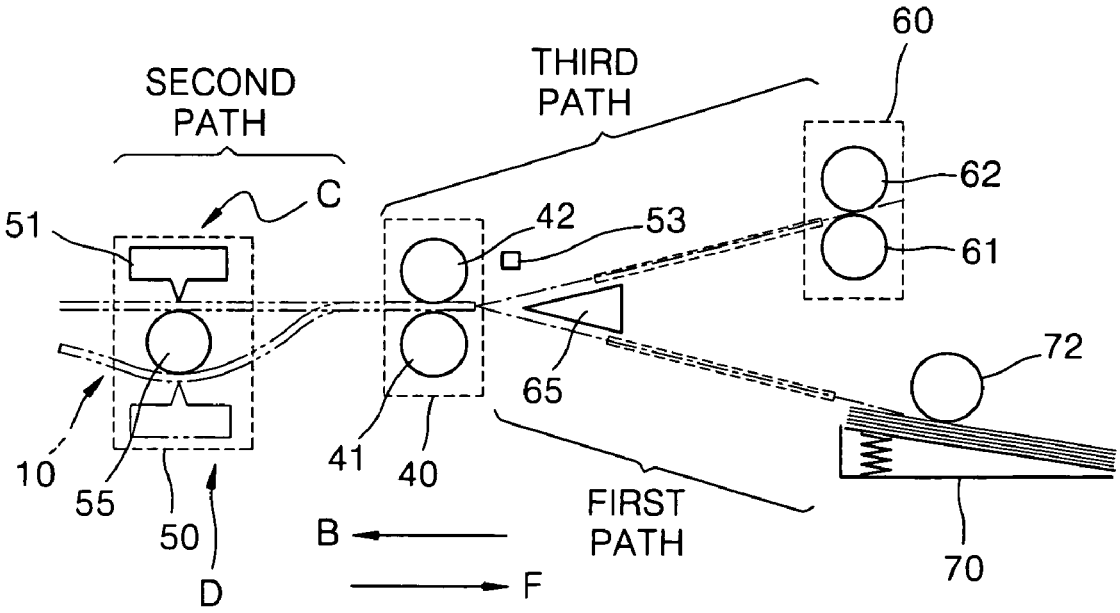
FIG. 3 is a view showing a thermal printer that is used in a method of printing the thermal medium by aligning image according to an embodiment of the present invention.

FIG. 3 is a view showing a thermal printer adapted for performing a method for aligning an image on a thermal medium according to an embodiment of the present invention.

As shown in FIG. 3, the thermal printer comprises at least a first path, a second path, and a third path, and conveys a thermal medium through the above paths. A pickup roller 72 picks up the medium 10 from a media storage unit 70 and conveys the medium through the first path. The first path is a medium 10 supply path for moving the medium 10 toward the second path. The second path is an area where the medium 10 is back-fed in a direction represented by arrow B and forward fed to a direction represented by arrow F (printing direction) for a printing operation. After the printing operation has been completed, the third path is a path by which the medium 10 is discharged finally.

A media guide 65 is disposed between the first path and the third path. The media guide 65 guides the medium 10 from the first path to the second path, and guides the medium 10 from the second path to the third path. In addition, after the printing operation, the media guide 65 guides the medium 10 from the second path to proceed toward the third path only, and prevents the medium 10 from proceeding toward the first path.

In the second path, an image is formed by an image forming unit 50. Before the images are formed on the first and second surfaces of the medium 10, the locations of the thermal printhead (TPH) 51 and the platen roller 55 of the image forming unit 50 should be at predetermined locations. That is, if the image is formed on the first surface of the medium 10, the TPH 51 should be located at position C in FIG. 3. If the image is formed on the second surface of the medium 10, the TPH 51 should be located at position D. It is desirable that the location of the TPH 51 changes by rotating the platen roller 55 and the TPH 51 centering on a rotary shaft of the platen roller 55. The change of TPH 51 location is performed when the TPH 51 is not obstructed by the medium 10, for example, before the medium 10 is supplied from the first path, or when the medium 10 is not returned to the second path after being conveyed toward the third path during the image formation on the first surface.

When the medium 10, after the first surface has been printed on, is backfed to the second path, the image is formed on the second surface of the medium 10 by the rotated TPH 51. In the above process, the medium 10 is gradually advanced by a conveying unit 40, discharged by a media discharging unit 60 after the image is formed on the second surface. The conveying unit 40 comprises a feeding roller 41 that conveys the medium 10, and an idle roller 42 that pushes the medium 10 to enter between the feeding roller 41 and the idle roller 42 toward the feeding roller 41.

Reference numeral 53 denotes an optical sensor that detects an edge of the medium 10. The media discharging unit 60 includes a discharge roller 61 and an idle roller 62, and the discharge roller 61 and the pickup roller 72 that can also be formed integrally using one roller having a combined function of picking up and discharging media 10.

Figure 4:
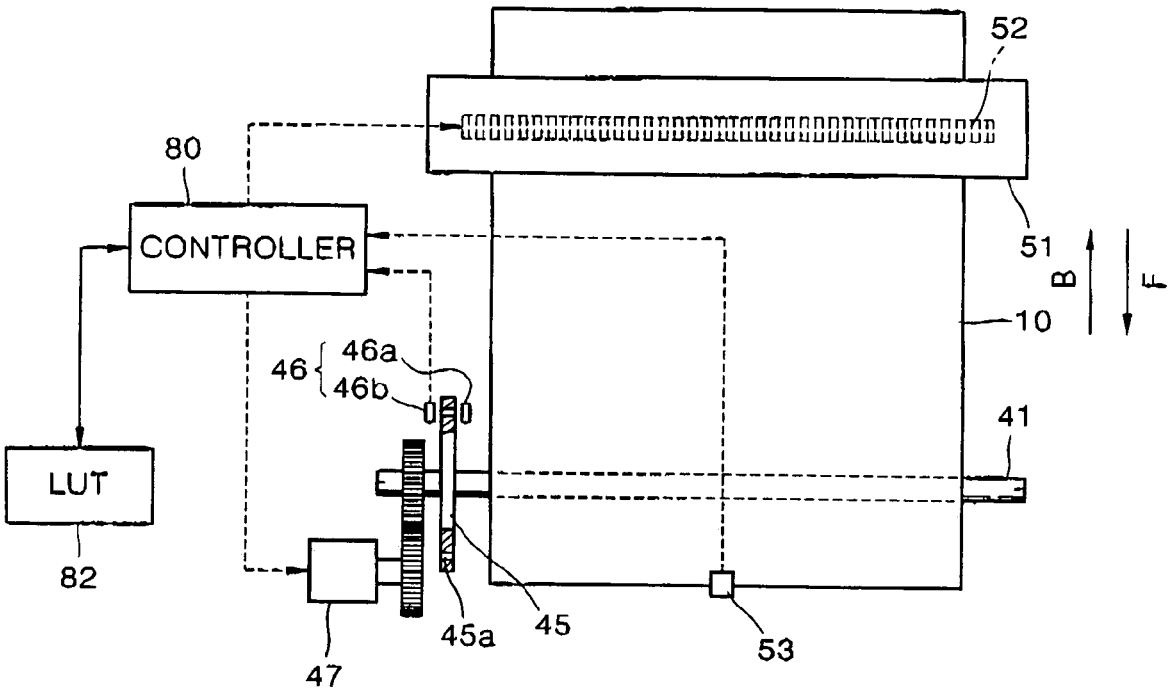
FIG. 4 is a schematic plan view showing a part of a device adopting the method of printing the thermal medium by aligning image according to an embodiment of the present invention.
Figure 5:
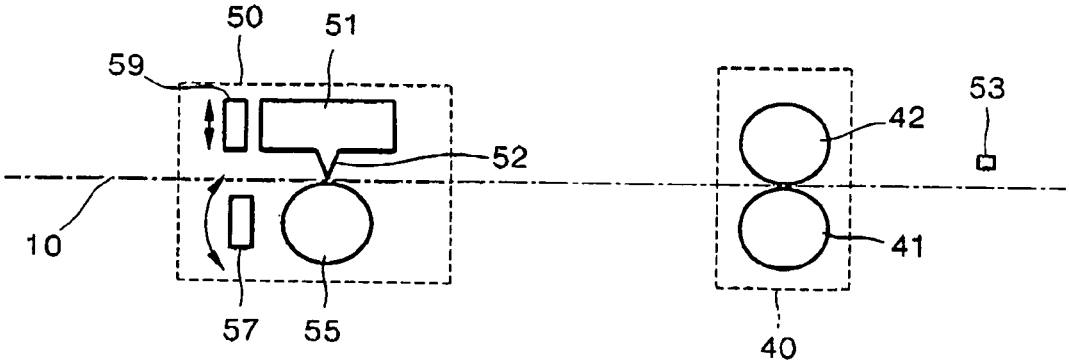
FIG. 5 is a schematic side view showing a part of the device shown in FIG. 4.

FIG. 4 is a schematic plan view showing a part of a device using the method for printing on thermal media by aligning images according to an embodiment of the present invention, and FIG. 5 is a schematic side view showing the device of FIG. 4.

In FIG. 4, the distance between the feed roller 41 and heating element (refer to reference numeral 52 of FIG. 4) of the TPH 51 on the medium 10 can be different depending on the surface of the medium 10 to be printed.

Referring to FIGS. 4 and 5, the TPH 51, the feeding roller 41, and the optical sensor 53 are sequentially disposed in the printing direction of the medium. The thermal medium 10, which enters between the platen roller 55 and the TPH 51, is controlled by the rotation of the feeding roller 41.

In the TPH 51, a plurality of heating elements 52 are preferably arranged in a row or a plurality of rows disposed perpendicular to the medium conveying direction. The heating elements 52 emit heats for a predetermined time period and at a predetermined temperature according to a signal voltage that corresponds to a particular color.

The medium 10 is conveyed to the direction represented by the arrow B, that is, the backfeeding direction, or to the direction represented by the arrow F, that is, the printing direction by the feeding roller 41 depending upon the operation being performed. An encoder disk wheel 45 is installed on an outer circumference of the feeding roller 41. Slits 45*a* are formed on an edge of the encoder disc wheel 45 at predetermined intervals, and rotary encoder sensors 46 including a light emitting portion 46*a* and a light receiving portion 46*b* are mounted on both sides of the slit 45*a*. The light emitting unit 46*a* of the rotary encoder sensor 46 emits light at predetermined intervals, and the light receiving unit 46*b* generates pulse signals whenever it receives light through the slit 45*a*. A controller 80 counts the pulse signals to measure the conveyed distance of the medium 10 that is conveyed by the feeding roller 41, and drives a driving motor 47 to control the conveyed distance of the medium 10 that is conveyed by the feeding roller 41. Reference numeral 82 denotes a look-up table (LUT).

The thermal printer includes a rotating unit 57 that rotates the TPH 51 and the platen roller 55 to perform the printing process for the second surface after performing the printing process for the first surface of the medium 10, and a vertical moving unit 59 that either separates the TPH 51 from the printing path or pushes the TPH 51 close to the printing path. The vertical moving unit 59 separates the TPH 51 a predetermined distance, for example, 1 to 2 mm, from the platen roller 55 so that the medium 10 can pass between the TPH 51 and the platen roller 55 when the medium 10 is backfed, preferably, to the third path.

In addition, the optical sensor 53 is disposed in front of the feeding roller 41 in the forward feeding direction, denoted by the arrow B, to transmit an optical output value of the medium 10 conveyed thereunder to the controller 80, and the controller 80 determines the edge of the medium 10 using the transmitted optical output value.

Figure 6:
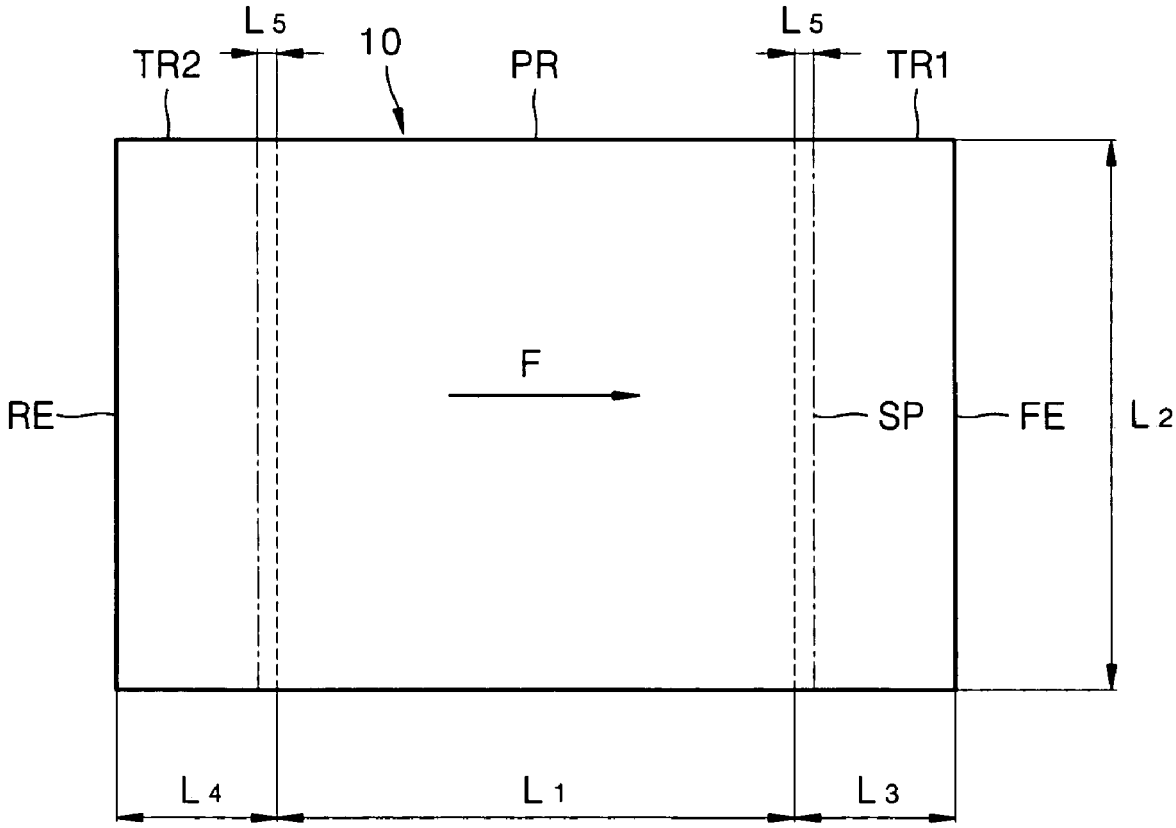
FIG. 6 is a view showing an example of the thermal medium used in an embodiment of the present invention.

FIG. 6 is a view of an example of the thermal medium according to an embodiment of the present invention.

Referring to FIG. 6, the thermal medium 10 can be classified into a printing region (PR), and tear-off regions to be removed after printing (TR1 and TR2). A transverse length ($L_1$) of the PR is 6 inches and a longitudinal length ($L_2$) of the PR is 4 inches, and a transverse length ($L_3$) of the first tear-off region (TR1) is about 1 inch and a transverse length ($L_4$) of the second tear-off region (TR2) is ⅓ inch. Arrow F denotes the conveying direction of the medium 10 during forward feeding for being printed. FE denotes a front edge, and RE denotes a rear edge. In FIG. 6, dotted lines denote tear-off lines, and dashed dot lines denote starting and ending positions of the actual printing region for performing borderless printing. Distance L5 is about 2 mm. In addition, SP denotes a printing start position.

A printing method according to an embodiment of the present invention will be described with reference to accompanying drawings.

Figure 7:
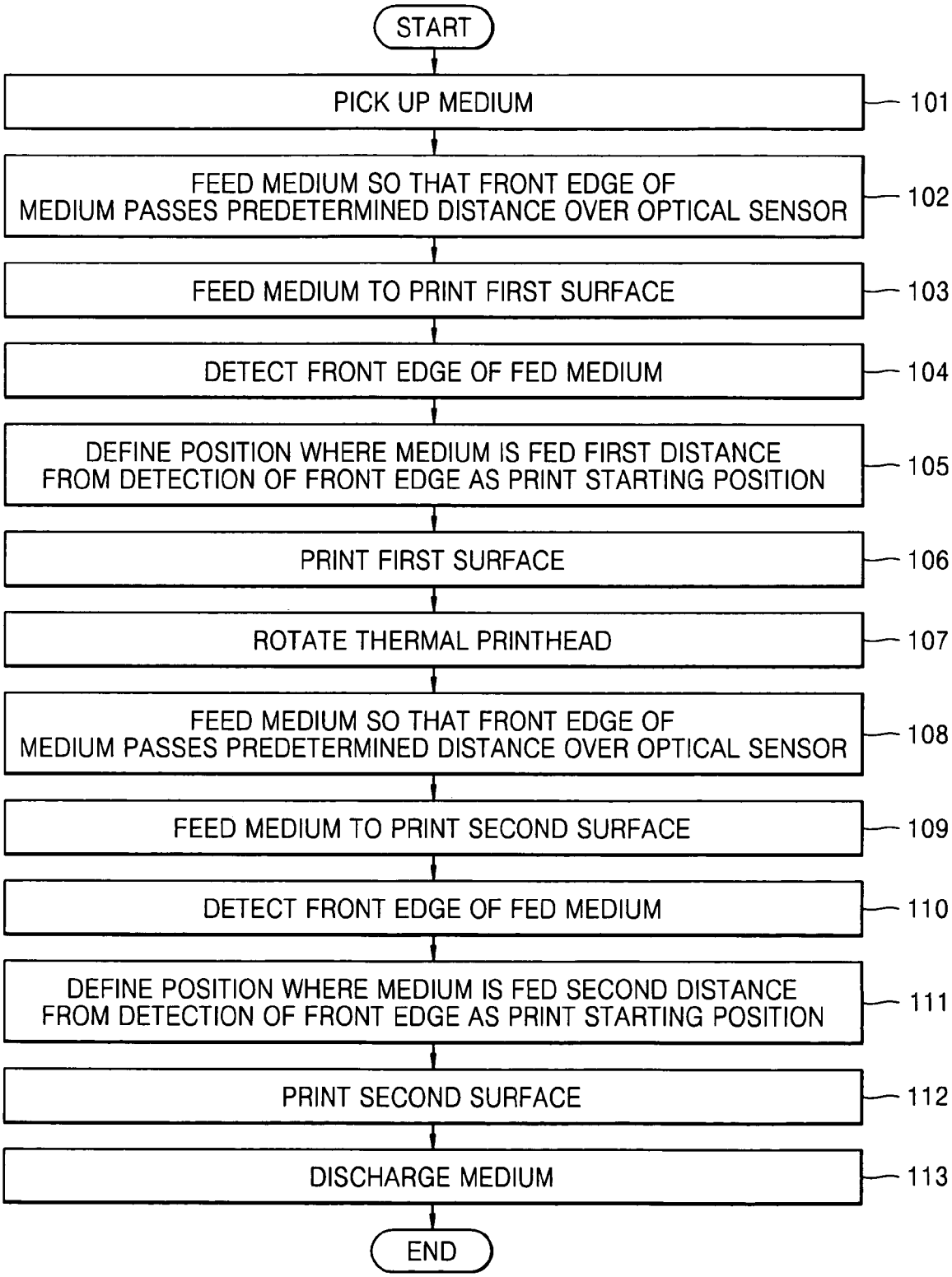
FIG. 7 is a flow chart illustrating the method for printing on a thermal medium by aligning the image according to an embodiment of the present invention.

FIG. 7 is a flow chart illustrating a printing method according to an embodiment of the present invention.

When a printing command is input into the controller 80 from a computer that is connected with the printer, a sheet of thermal media 10 is picked up by the pickup roller 72 from the media container 70 and enters the first path (S101).

The medium 10 entering the first path is supplied to the feeding roller 41 by the media guide 65, and the feeding roller 41 makes the medium 10 backfed to the second path in the direction represented by the arrow B (S102). Here, the TPH 10 is raised so that the medium 10 can pass between the TPH 51 and the platen roller 55 easily.

Figure 8A:
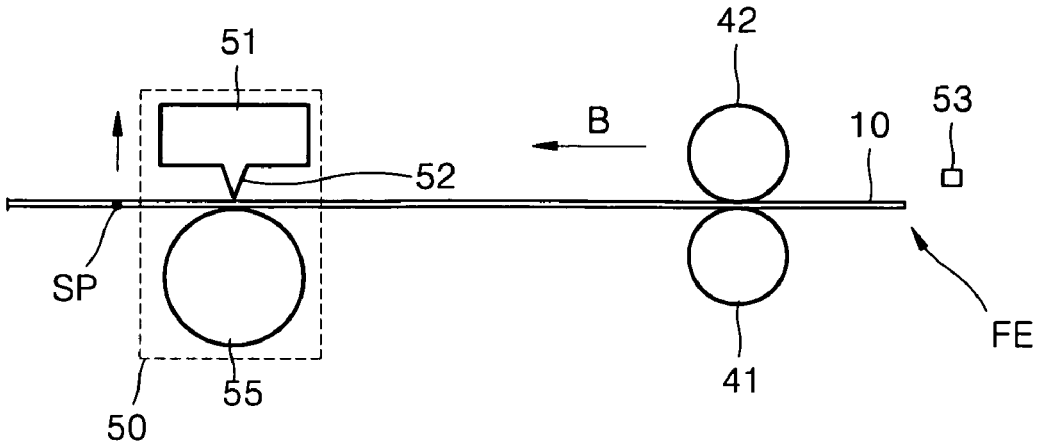
FIGS. 8A through 8F illustrating the method for printing on the thermal medium by aligning the image according to an embodiment of the present invention.

As shown in FIG. 8A, it is desirable that the front edge (FE) of the medium is located between the feed roller 41 and the optical sensor 53 after passing the optical sensor 53. In addition, a print starting position (SP) of the medium 10 is past a predetermined distance ahead of the lower portion of the heating element 52.

The TPH 51 is adhered to the medium 10, and the medium 10 is conveyed in the direction represented by the arrow F to start the printing of the first surface (S103).

Figure 8B:
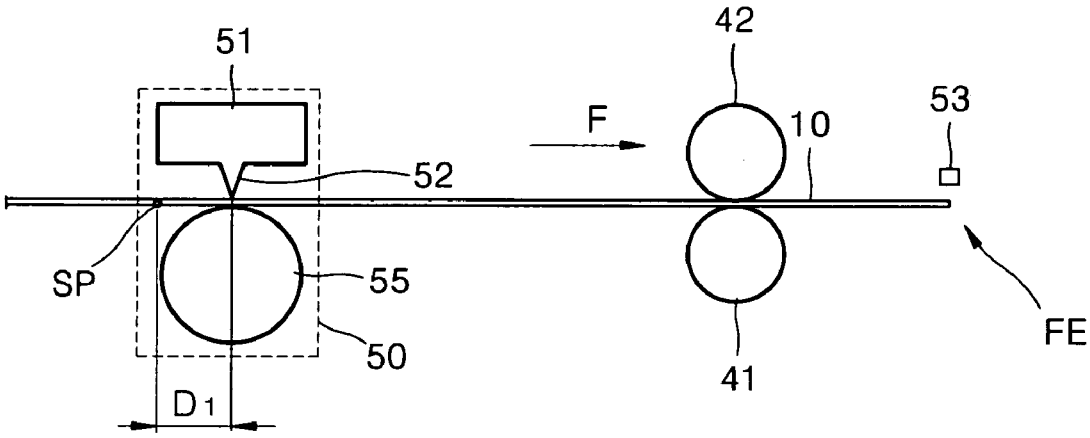
Figure 8C:
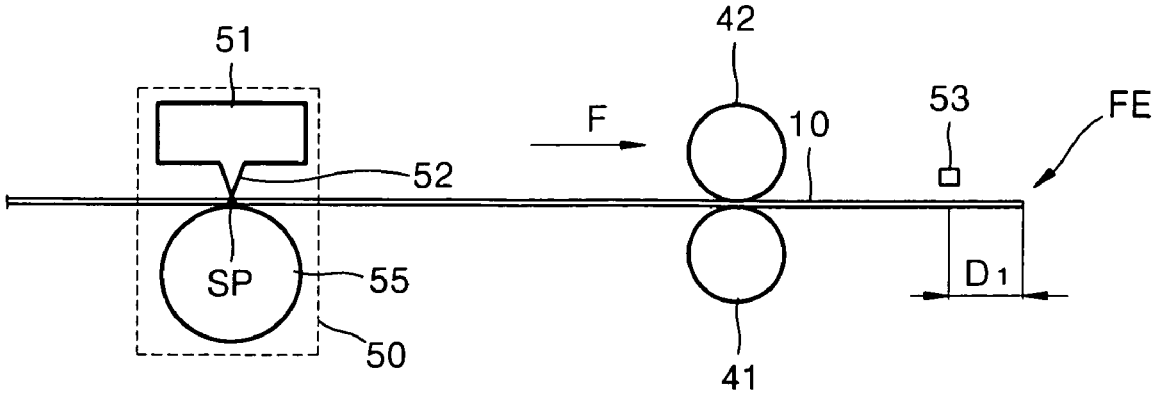

As shown in FIG. 8B, when the optical sensor 53 detects the front edge (FE) of the medium 10 (S104), the medium 10 is further fed a first distance D, stored in the LUT 82 so that the print starting position SP can be disposed under the heating element 52 as shown in FIG. 8C (S105). That point is defined as the print starting position of the first surface. The movement of the first distance D, is controlled by the rotary encoder sensor 46 from the point when the front edge FE of the medium 10 is detected by the optical sensor 53.

In addition, color image data corresponding to the print layer of the first surface, for example, yellow and magenta image data, is transmitted from the controller 80 to the TPH 51 to perform the printing operation (S106).

When the printing process for the first surface is completed, the medium 10 is further fed a predetermined distance forwardly so that the medium 10 does not contact the image forming unit 50. In addition, the image forming unit 50 is rotated so that the TPH 51 faces the second surface of the medium 10 (S107).

Figure 8D:
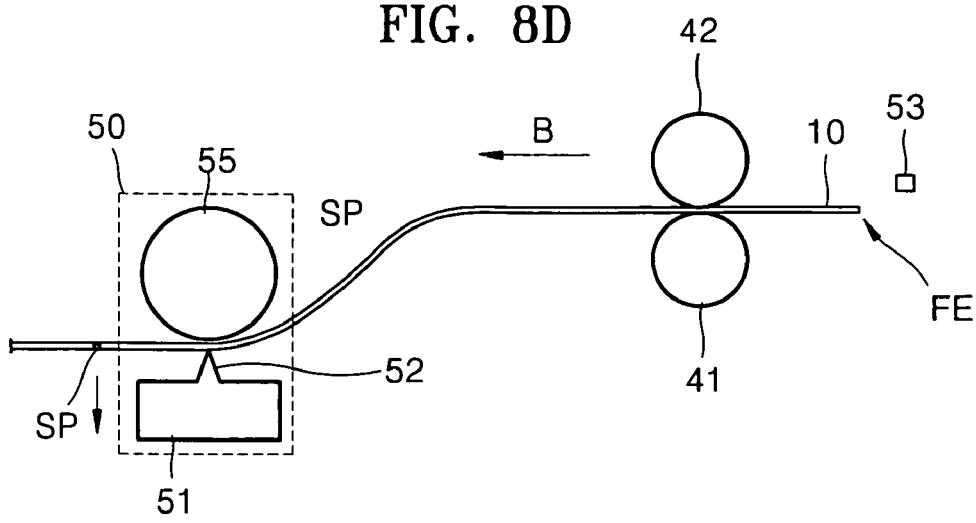

Next, a gap, through which the medium 10 can pass without resistance, is formed between the platen roller 55 and the TPH 51 by lowering the TPH 51 slightly, and the medium 10 is backfed to the second path by the feeding roller 41 in preparation for printing on the second surface (S108). Here, as shown in FIG. 8D, it is desirable that the front edge FE of the medium 10 be disposed between the feeding roller 41 and the optical sensor 53 past the optical sensor 53. In addition, the print starting portion SP of the medium 10 is past a predetermined distance from the heating element 52 of the TPH 51.

The TPH 51 is adhered to the medium 10, and the medium 10 is conveyed in a direction represented by the arrow F to start the printing operation on the second surface (S109).

Figure 8E:
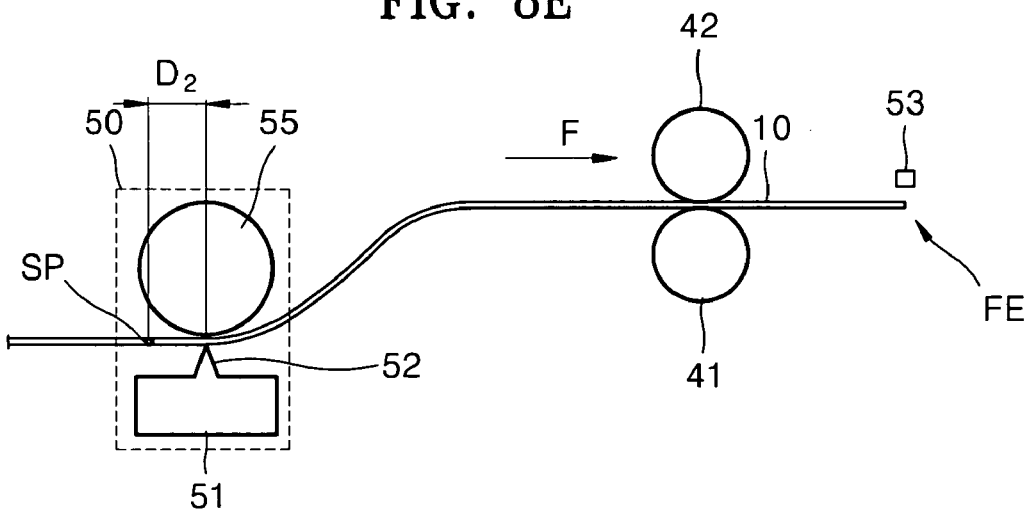
Figure 8F:
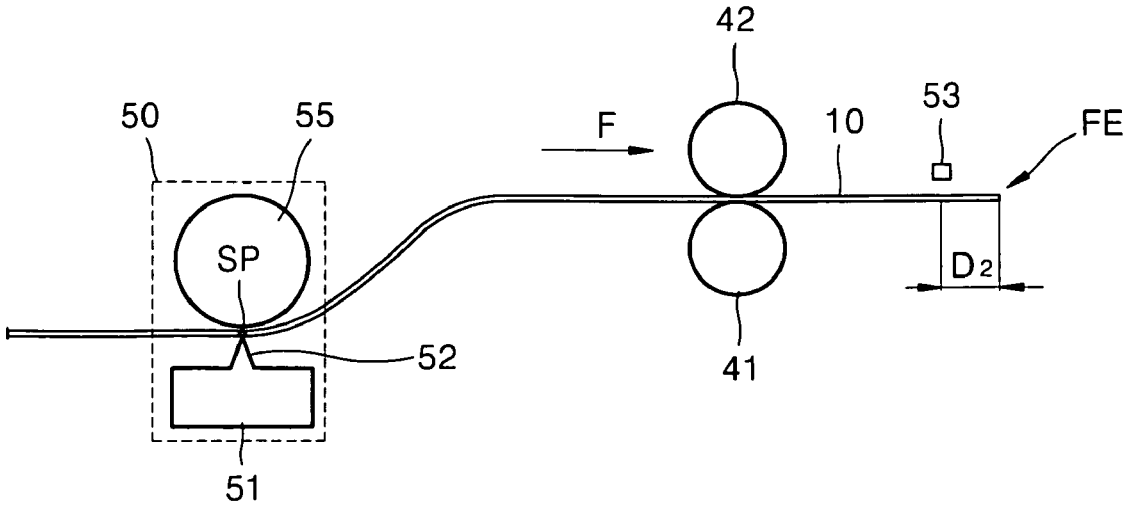

In addition, as shown in FIG. 8E, when the optical sensor 53 detects the front edge FE of the medium 10 (S110), the medium 10 is further fed a second distance $D_2$ stored in the LUT 82 so that the print starting position SP is disposed under the heating element 51 (S111). That point is defined as the print starting position for the second surface. The movement of the medium 10 for the second distance $D_2$ is controlled by the rotary encoder sensor 46 from when the front edge (FE) of the medium 10 is detected by the optical sensor 53.

Then, the controller 80 transmits color image data corresponding to the printing layer of the second surface, for example, cyan (C) image data, to the TPH 51 to perform the printing process (S112).

When the printing process for the second surface is completed, the medium 10 is conveyed to the third path, the conveying unit 40 stops conveying the medium 10 and the medium 10 is discharged out of the printer by the media discharge unit 60 (S113).

In the above embodiment, the first and second distances $D_1$ and $D_2$ are previously stored in the LUT 82. However, in a case where the image alignments of the first and second surfaces are not performed well, the first and second distance $D_1$ and $D_2$ may be first measured and then stored in the LUT 82, rather than using a predetermined distance that is stored at the time of manufacturing or is input only once.

Figure 9:
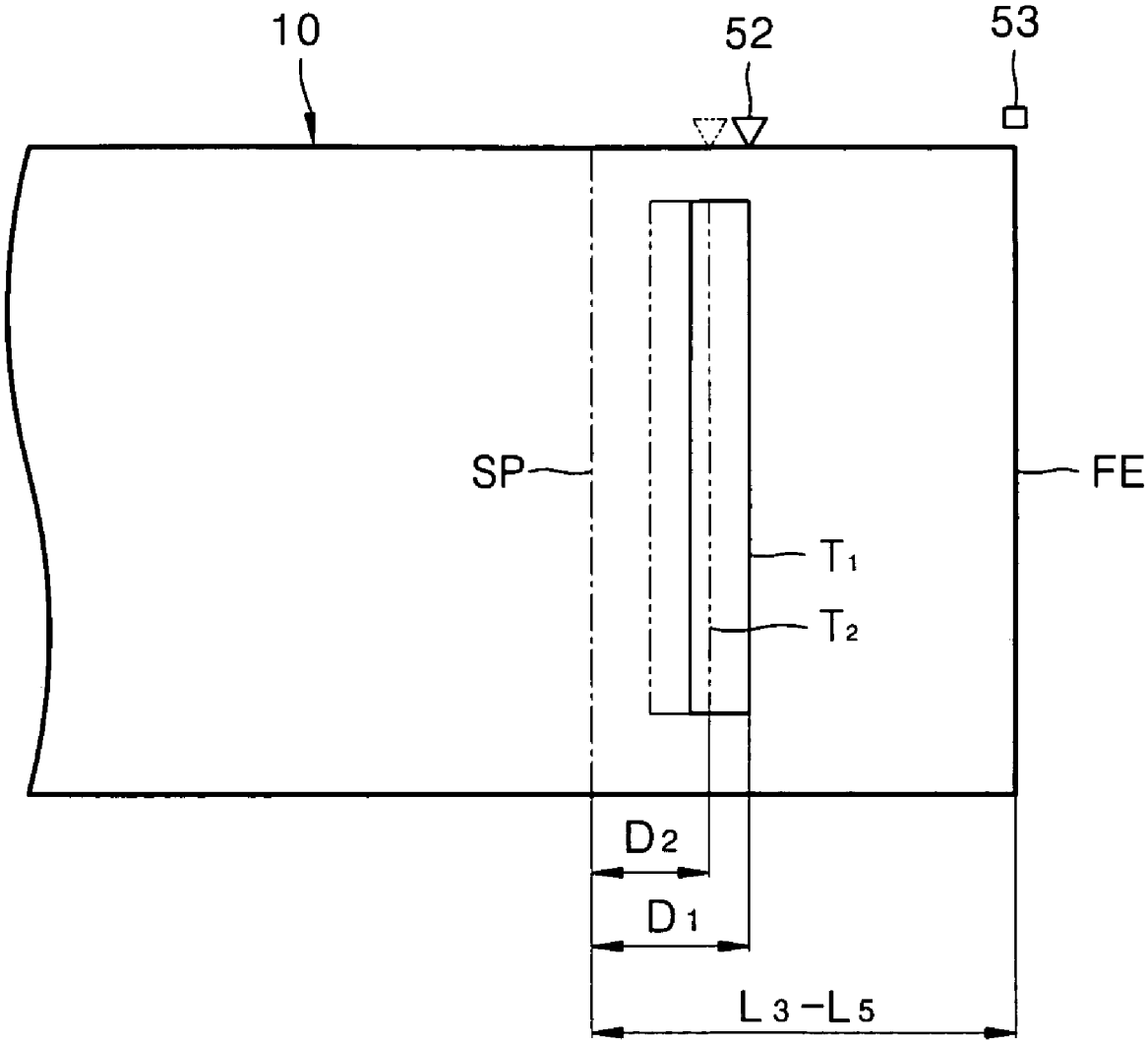
FIG. 9 is a view illustrating a method for measuring a first distance and a second distance according to an embodiment of the present invention.

FIG. 9 is a view illustrating a method for measuring the first and second distances $D_1$ and $D_2$.

Referring to FIG. 9, when the front edge FE of the medium 10 is detected by the optical sensor 53, the distance between the heating element 52 of the TPH 51 and the front edge FE can be different when the first surface is printed and when the second surface is printed. For example, in printing the first surface, the print starting position SP is separated by the first distance $D_1$ from the heating element 52 of the TPH 51 at the point when the front edge FE of the medium 10 is detected during the printing of the first surface of the medium 10. While, in printing the second surface, the heating element 52 is separated by the second distance $D_2$ from the print starting position SP when the front edge (FE) of the medium 10 is detected by the optical sensor 53. When the front edge (FE) is detected, predetermined test patterns T1 and T2 are printed on the first and second surfaces, respectively, during the respective printing operations. The medium 10 is backfed so that test patterns T1 and T2, respectively, can be detected by optical sensor 53 prior to the respective printing operation.

In addition, a distance is calculated by subtracting the distance measured between the front edge FE and the test pattern $T_1$ from a length ($L_3$–$L_5$) between the front edge FE and the print starting position SP is the first distance $D_1$, and a distance calculated by subtracting the measured distance between the front edge FE and the test pattern $T_2$ from the length ($L_3$–$L_5$) is the second distance $D_2$. The measured first and second distances $D_1$ and $D_2$ are stored in the LUT 82, thus the measured first and second distances $D_1$ and $D_2$ can be used in the actual printing process.

According to the printing method of an embodiment of the present invention, the print starting position is aligned to perform the dual-side printing operation while feeding the thermal medium in the printing direction. Therefore, the image aligning can be made accurately.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A method of printing a thermal medium by aligning image, the method comprising:

(a) feeding a thermal medium having a first surface and a second surface so that a print starting position of the medium is past a predetermined distance from heating elements of a thermal printhead;

(b) printing a first test pattern on the first surface when a front edge of the medium is detected by an edge detection sensor while feeding the medium;

(c) measuring a first distance between the front edge and the first test pattern by detecting the first test pattern using the edge detection sensor;

(d) rotating the thermal printhead to face the second surface;

(e) feeding the thermal medium so that the print starting position of the medium is past a predetermined distance from the heating elements of the thermal printhead;

(f) printing a predetermined second test pattern on the second surface when the front edge of the medium is detected by the edge detection sensor; and (g) measuring a second distance between the front edge and the second test pattern by detecting the second test pattern.

2. The method of claim 1, wherein step (b) further comprises calculating a third distance by subtracting the first distance from a distance between the front edge and the print starting position, wherein a position where the medium is fed the third distance from a point when the front edge is detected is defined as the print starting position of the first surface.

3. The method of claim 2, wherein step (g) further comprises calculating a fourth distance by subtracting the second distance from the distance between the front edge and the print starting position, wherein a position where the medium is fed the fourth distance from a point when the front edge is detected is defined as the print starting position of the second surface.

4. The method of claim 3, wherein the thermal printhead, a feeding roller, and the edge detection sensor are sequentially disposed in a printing direction, and steps (a) and (e) are feeding the medium until the front edge of the medium is between the feeding roller and the edge detection sensor.

5. The method of claim 4, further comprising the steps of:

(h) feeding the thermal medium so that the print starting position of the medium is past a predetermined distance from the heating elements of the thermal printhead;

(i) feeding the medium and starting a printing operation on the first surface at the position where the medium is fed the third distance from the point when the front edge is detected by the edge detection sensor;

(j) rotating the thermal printhead to face the second surface;

(k) feeding the medium so that the print starting position is past a predetermined distance from the heating elements of the thermal printhead; and (l) feeding the medium and starting a printing operation of the second surface at the position where the medium is fed the fourth distance from when the front edge is detected by the edge detection sensor.

6. The method of claim 5, wherein steps (i) and (l) comprise:

detecting the front edge of the medium by the edge detection sensor; and controlling a rotation of the feeding roller so that the front edge can be separated the third distance or the fourth distance from the edge detection sensor.

7. The method of claim 5, wherein the thermal medium includes a print region and a tear-off region including the front edge, and the print starting position is formed at the tear-off region.

8. The method of claim 1, wherein the edge detection sensor is an optical sensor.

9. A method for printing a thermal medium by aligning image comprising the steps of:

(a) feeding a thermal medium having a first surface and a second surface so that a preset print starting position of the medium is past a predetermined distance from heating elements of a thermal printhead;

(b) feeding the medium, determining a position where the medium is fed a first distance from a point when a front edge is detected and set as a first print starting position, performing a printing process on the first surface;

(c) rotating the thermal printhead to face the second surface;

(d) feeding the medium so that the print starting position is past a predetermined distance from the heating elements of the thermal printhead; and (e) feeding the medium, determining a position where the medium is fed a second distance from a point when a front edge is detected and set as a second print starting position, and performing a printing process on the second surface.

10. The method of claim 9, wherein the edge detection sensor is an optical sensor.

11. The method of claim 9, wherein the thermal printhead, a feeding roller, and the edge detection sensor are sequentially disposed in a printing direction, and steps (a) and (d) are feeding the medium until the front edge of the medium is between the feeding roller and the edge detection sensor.

12. The method of claim 9, wherein steps (b) and (e) comprise:

detecting the front edge of the medium using the edge detection sensor; and controlling the rotation of the feeding roller so that the front edge can be separated by the first distance or the second distance from the edge detection sensor.

13. The method of claim 9, wherein the thermal medium includes a print region and a tear-off region including the front edge, and the print starting position is formed at the tear-off region.

* * * * *